US005954595A

United States Patent [19]

Antonious

[11] Patent Number: 5,954,595

[45] Date of Patent: Sep. 21, 1999

[54] METALWOOD TYPE GOLF CLUB HEAD WITH BI-LEVEL OFF-SET OUTER SIDE-WALLS

[76] Inventor: Anthony J. Antonious, 7738 Calle Facil, Sarasota, Fla. 34238

[21] Appl. No.: 09/013,892

[22] Filed: Jan. 27, 1998

[51] Int. Cl.[6] ..... A63B 53/04

[52] U.S. Cl. ..... 473/327; 473/345; 473/349

[58] Field of Search ..... 473/324, 325, 473/326, 349, 345, 327; D21/733, 734, 735

[56] References Cited

U.S. PATENT DOCUMENTS

D. 318,891 8/1991 Duclos .
D. 390,616 2/1998 Maltby .
D. 399,289 10/1998 Sheets .
4,065,133 12/1977 Gordos .
5,028,049 7/1991 McKeighen .
5,467,989 11/1995 Good .
5,766,095 6/1998 Antonious .

*Primary Examiner*—Sebastiano Passaniti
*Attorney, Agent, or Firm*—Aquilino & Welsh

[57] ABSTRACT

A metalwood type golf club head including a club head body having a toe, heel, top surface, bottom sole, side surfaces, rear surface and ball striking face having at least one raised, and preferably two, elongated, aerodynamically shaped appendage extending outwardly from a side surface, in a front to rear direction, from a point adjacent said ball striking face to said rear surface. The structure provides improved weight distribution for better balance, adds strength and stability and provides aerodynamic surfaces to increase club head speed particularly on larger club heads designs.

25 Claims, 13 Drawing Sheets

FIG. 5
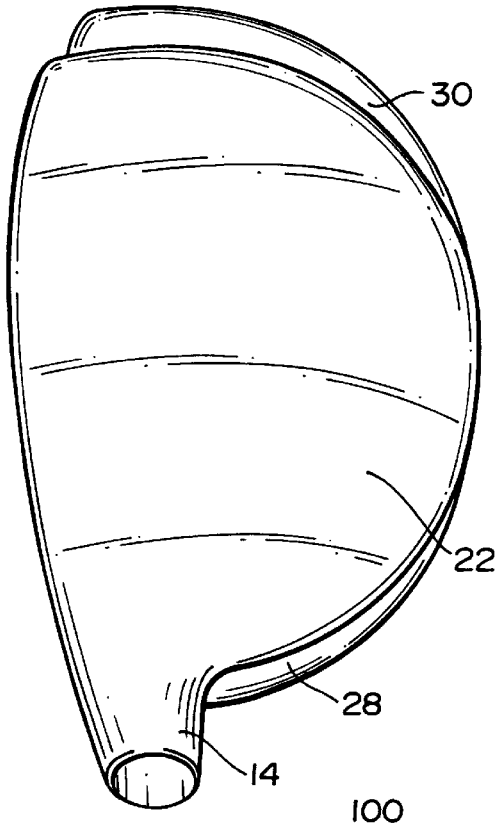
FIG. 6
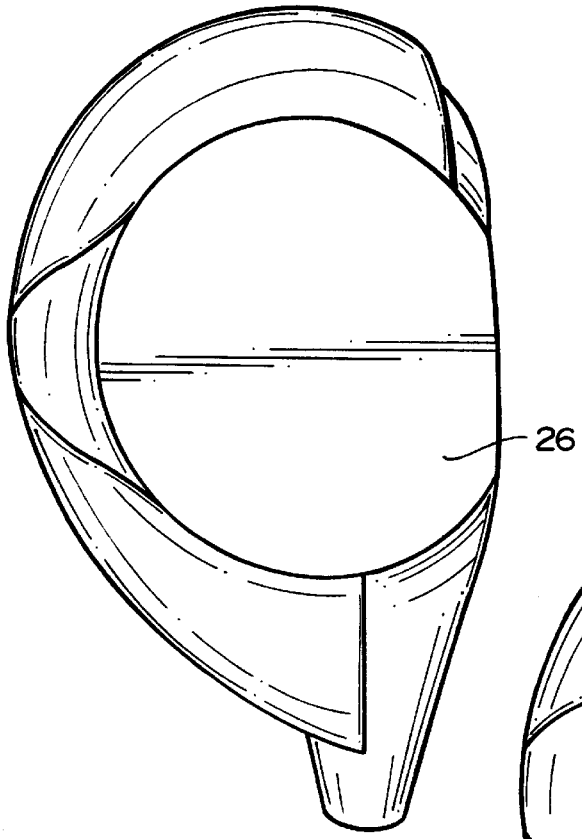
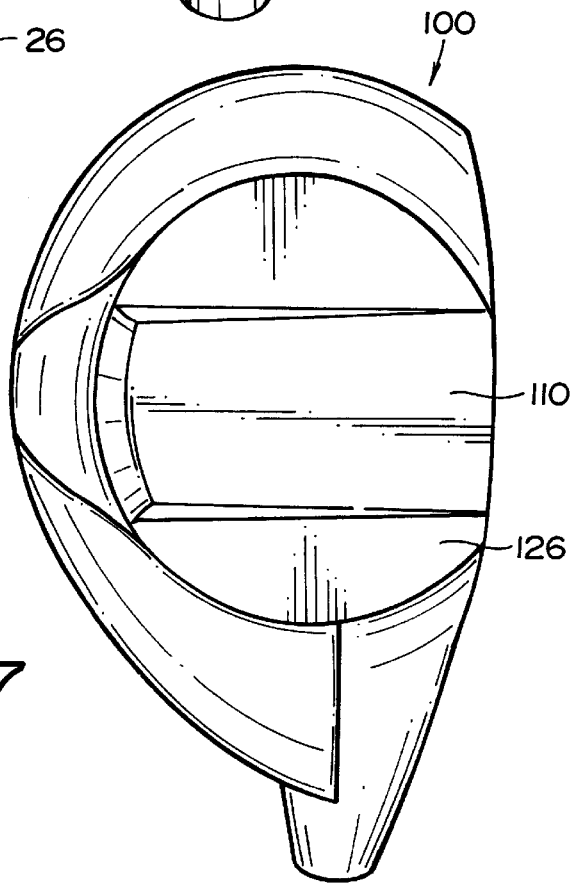
FIG. 7

FIG. 27
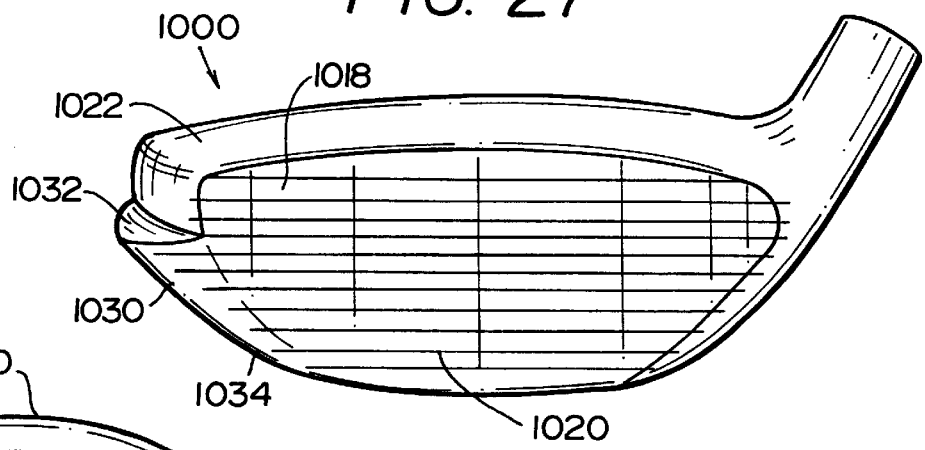
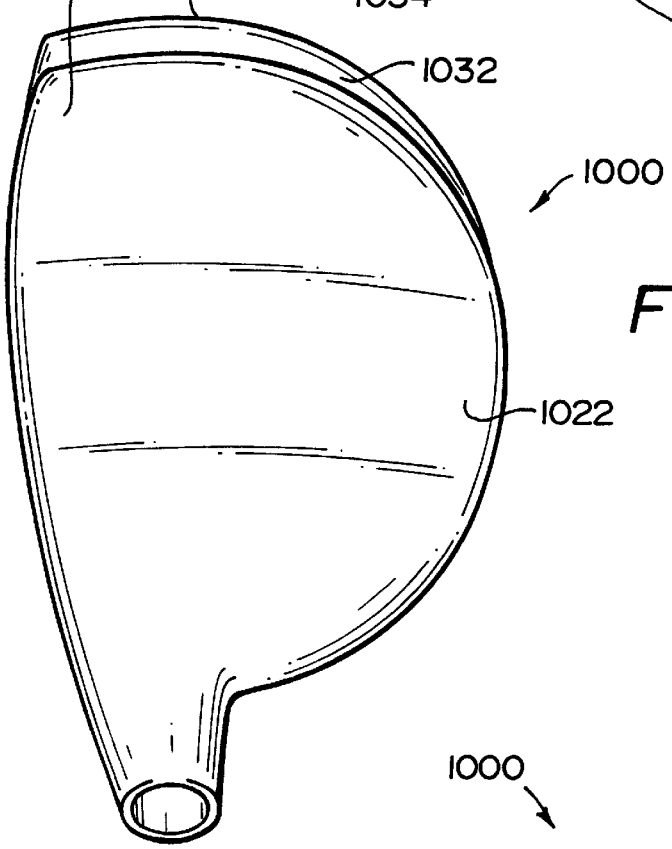
FIG. 28
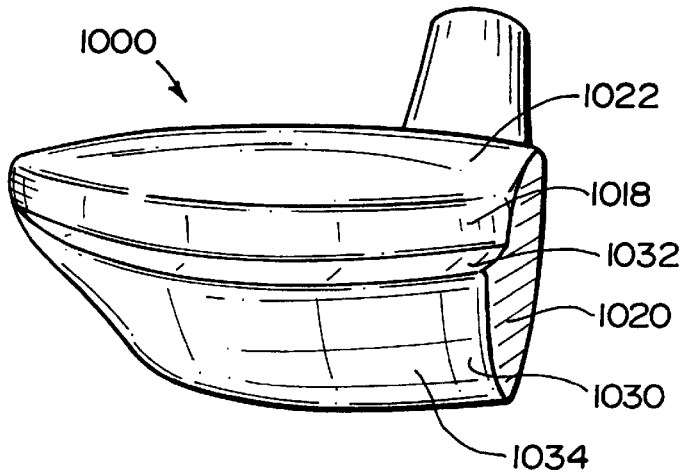
FIG. 29

FIG. 33
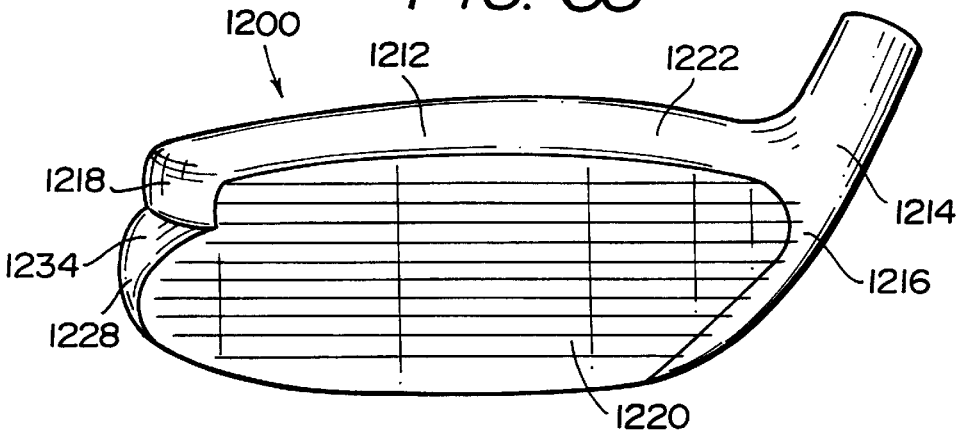
FIG. 34
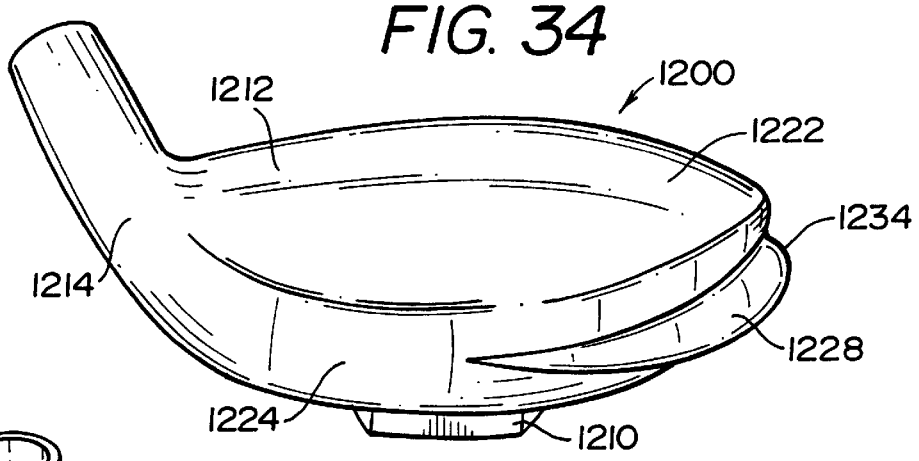
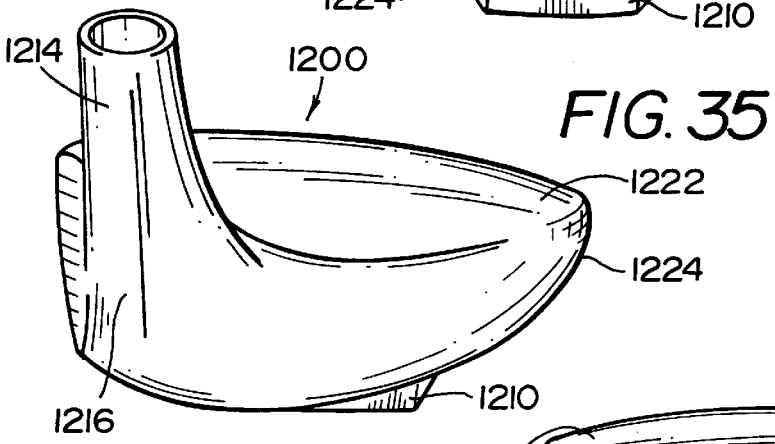
FIG. 35
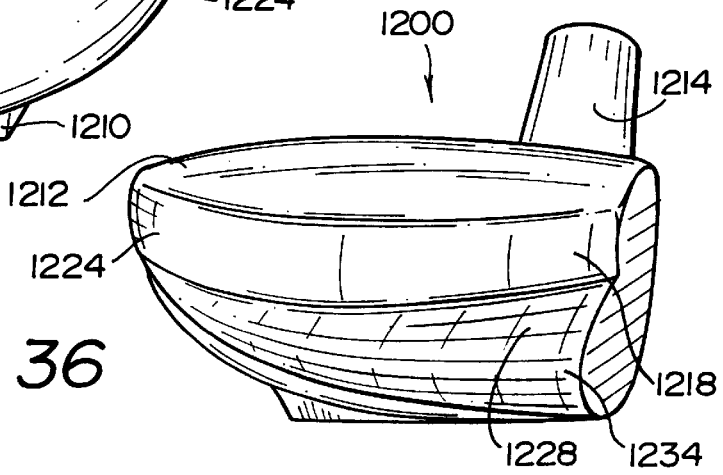
FIG. 36

METALWOOD TYPE GOLF CLUB HEAD WITH BI-LEVEL OFF-SET OUTER SIDE-WALLS

BACKGROUND OF THE INVENTION

The present invention relates to a metalwood type golf club head and, in particular, to a metalwood type club head having bi-level, off-setting outer side-walls.

Most wood type golf club heads are generally made with one-level side-walls that surround the lower portion of the club head, and which are located between the upper crown portion and the sole or bottom portion. The side-walls interface with the club face, at both of the opposing toe and heel sections of the club head. These basic components, when unitized, form the outer shape of a hollow shell of a completed metalwood club head requiring only to be finished and foamed, if desired.

The present trend is to make metalwood club heads larger and larger, since the increasing demand for such clubs continues by many golfers of all calibers. Golfers are convinced the larger club heads are much easier to hit and result in hitting a golf ball greater distances. However, there is a limit to how big a club head can be, before it loses its size advantages. Even with the popular use of the lighter and stronger titanium to produce the larger club heads, some elements of physics and dynamics will always dramatically affect the larger club heads. Being larger involves more bulk which creates "drag" that greatly reduces club head speed. Unless a golfer has a golf swing that produces a club head speed greater than 90 mph, a larger sweet-spot on the larger club face will not compensate for the loss of distance, due to the increased drag incurred. Also, lack of proper club head balance and inadequate reinforcement greatly affects the overall performance of the larger club heads.

The cost of the larger club heads, which are almost totally made of titanium, are priced out of range of the average golfer. Somewhat smaller club heads, with titanium face inserts are helping to lower the selling prices of certain brands. However, there is a great need for a larger metalwood club head that improves and overcomes some of the existing performance and cost related shortcomings associated with the larger metalwood type golf clubs currently marketed.

Various attempts have been made to improve on the construction of metalwood type club heads to enhance their overall shapes and performances. This is evidenced by U.S. Pat. Nos. 3,997,170 to Goldberg, 4,065,133 to Gordos, and 5,465,970 to Adams et al, as well as my own U.S. Pat. Nos. 4,828,265, 5,193,810, 5,511,786 and 5,643,104.

SUMMARY OF THE INVENTION

The metalwood type golf club heads of the present invention include several unique variable side-wall structures. A first embodiment is formed with outer side-walls that have two distinctive levels, an upper level and an off-setting lower level. Both side-wall levels are located between the crown section and the sole or bottom section of the club head. The upper level of the outer side-walls encircles the majority of the club head from the toe section, rearwardly to the heel section. The lower level of the side-walls protrudes outwardly to expand the lower portion of the shell. This extends the outermost mass of the lower level side-wall beyond the perimeter of the crown on both the toe and heel sections of the club head.

Several advantages are produced by this unique structural configuration. Looking downward, when the club head is at address, the golfer sees a much larger overall perimeter, even though the club face, the crown portion and portions of the side-walls remain basically a standard size for comparable larger metalwoods. However, this club head's enhanced, low profile aerodynamics, added reinforcement and expanded perimeter weighting, for improved variable center of gravity determination, created by its overall unique configuration, produces superior club balance, a larger sweet spot, improved, more solid ball contact, and greater club head stability at impact.

Among the objects of the present invention is the provision of a metalwood type golf club head that provides improved aerodynamics for increased club head speed and intensified swing-plane control enhancing its overall performance.

Another object of the present invention is the provision of a metalwood type golf club head that is enlarged without increasing the height of its club face, the size of the crown portion, sole portion, or the height of the side-walls, beyond the size of similar components of a current average size metalwood club head.

Still another object of the present invention is the provision of outer side-walls having improved off-set, bi-level configuration, permitting precision distribution of additional mass to the outermost perimeter of the club head for optimum relocation of the center of gravity, which substantially increases club head balance to produce greater club head stability at impact.

These and other objects of the present invention will be understood from the description that follows or may be learned from the practice of the invention. The objects and advantages of the invention will be realized and attained by use of the elements and combinations described in the appended claims.

To achieve the objects and in accordance with the purpose of the invention as embodied and broadly described herein, the invention comprises a metalwood type golf club head body, including heel and toe portions, sole or bottom, crown, ball striking face and a hosel; and an improved bi-level outer side-wall structure having an off-set configuration forming its lower portion. By extending outwardly, the side wall structure creates a wing-like outermost member, surrounding or partially overlaying the perimeter of the club head. This unique appendage produces a number of improvements to the club head. It provides advanced aerodynamic characteristics that greatly increase club head speed. It permits considerably more linear or lateral balance made possible by the shape and mass of the bi-level, off-set member which extends beyond the outermost perimeter of the centrally located main body of the club head. The peripheral appendages also allow the center of gravity to be shifted to precise, desired locations on the club head as may be preferred by individual golfers.

BRIEF DESCRIPTION OF THE DRAWINGS

FIG. 5 is a top plan view thereof.

FIG. 6 is a bottom view thereof.

FIG. 7 is a bottom view of a second embodiment in accordance with the present invention.

FIG. 27 is front elevational view of a eleventh embodiment of the present invention.

FIG. 28 is a top plan view of FIG. 27.

FIG. 29 is a toe end elevational view of the club head of FIG. 27.

FIG. 33 is a front elevational view of a thirteenth embodiment of a golf club head in accordance with the present invention.

FIG. 34 is a rear elevational view of the club head of FIG. 33.

FIG. 35 is a heel end elevational view of the club head of FIG. 33.

FIG. 36 is a toe end elevational view of the club head of FIG. 33.

DESCRIPTION OF THE PREFERRED EMBODIMENTS

Figure 1:
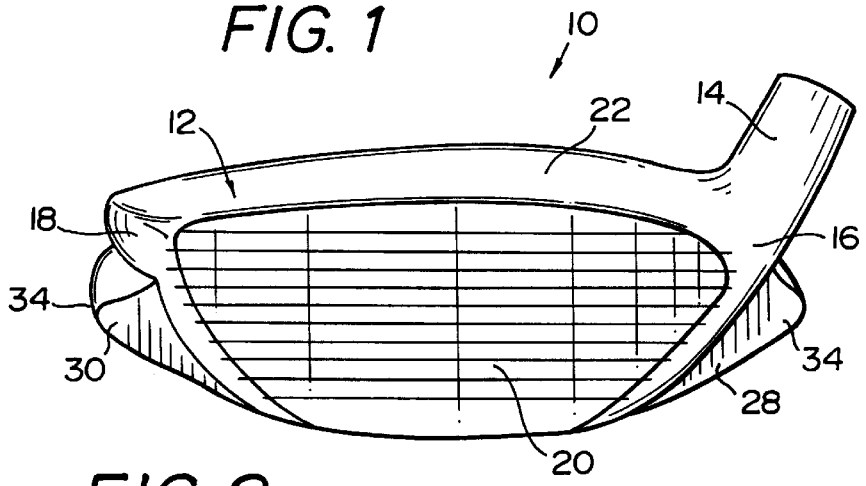
FIG. 1 is a front elevational view of a golf club head in accordance with the present invention.
Figure 2:
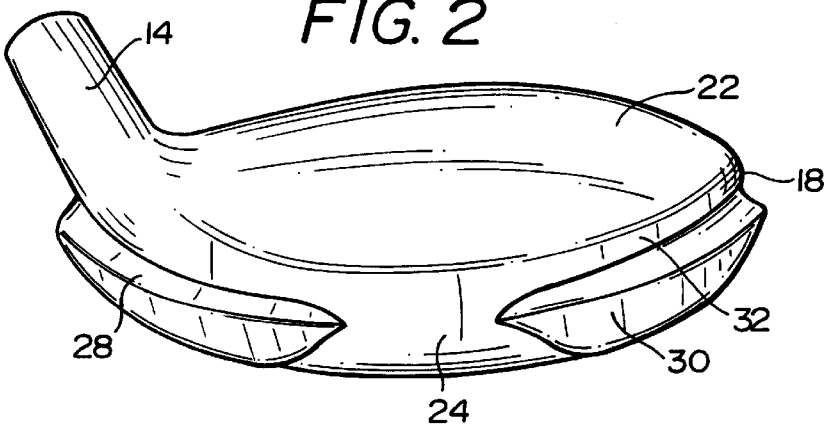
FIG. 2 is a rear elevational view thereof.
Figure 3:
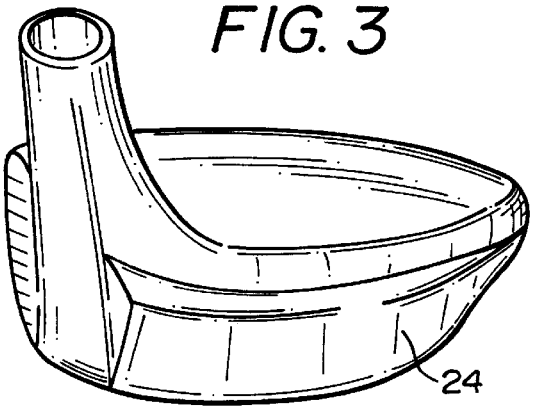
FIG. 3 is a heel end elevational view thereof.
Figure 4:
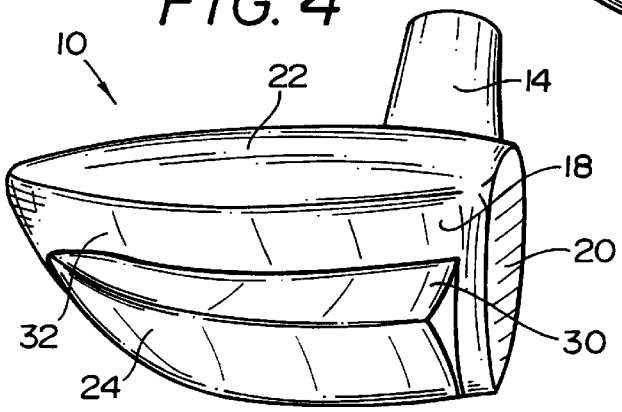
FIG. 4 is a toe end elevational view thereof.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The present invention purposely maintains and adheres to using conventional club head shapes and basically standard sizes of larger metalwoods while creating the various embodiments of the present invention. The main components of the club heads include a club face having a bulge and roll surface configuration, a crown, side-walls, rear wall, a bottom sole and a hosel. A prime objective of this invention is to produce a more aerodynamic club head with better, more reliable and more consistent performance and ball striking results without altering or increasing its conventional shape or the standard dimensions of the club head body and its key or main components. This is accomplished by having a club face with dimensions of approximately 3½" across the upper portion of the club face in a heel to toe direction, up to approximately 4½ inches across the lower portion of the club head, approximately 1½" from the upper ridge to the bottom and approximately 1⅝" from the crown surface to the bottom of the club face. The overall shape of the club face is very sleek, aerodynamic, and has a low profile. The bi-level, off-set configuration of the side walls are aerodynamically contoured to match the aerodynamic perimeter of the club head.

The frontal portions of the bi-level, off-set or wing-like members are aerodynamically shaped at the toe and heel sections of the club head. The unique and practical structure of this invention produces a club head that has a larger outermost perimeter, improved aerodynamics and perimeter weighting without increasing the overall size and weight of the club head, while producing significantly superior results when hitting a golf ball.

Referring to the drawings, FIGS. 1–6 show a first embodiment of a golf club head 10 including a club head body 12, hosel 14, heel 16, toe 18, ball striking face 20, upper surface 22, rear surface 24 and bottom sole 26. The improvement lies in a pair of wing-like aerodynamic appendages 28, and 30 formed on the side 32 of the club head 10 and set behind the ball striking face 20. Each of the appendages 28, 30 have an elongated, aerodynamic airfoil shaped surfaces 34 generally parabolic in shape which extends outwardly beyond the outer perimeter of the club head body 12 as can particularly be seen with reference to FIGS. 1, 2 and 5. Preferably the appendages 28 and 30 are integrally formed with the thin metal shell which forms the golf club head 10 and therefore are hollow. The appendages 28 and 30 lie in a plane which is generally parallel to both the top surface 22 and bottom surface 26 of the club head 10 and extend in a front to rear direction on the club head 10 from a point adjacent the ball striking face 20 to the rear surface 24.

Since the appendages 28 and 30 extend outwardly from the side 32 of the club head 10 an overall appearance of a larger club head is presented to the golfer than would appear with a conventional sized club head body. The appendages 28 and 30 add additional peripheral weight to the club head, particularly in a heel 16 to toe 18 direction and add strength and stability to the club head 10. The aerodynamic surfaces of the appendages 28 and 30 create favorable, productive turbulence, thus reducing drag at the rear surface 24 of the club head 10 increasing club head speed and creating lift as it is swung, particularly when used by a player generating fast club head speed swings. As can be seen from FIG. 2, the appendages 28, and 30 extend toward, but do not reach, the entire way around the rear surface 24.

FIG. 7 shows a golf club head 100 in accordance with the present invention, which is identical to the club head 10 described with respect to FIGS. 1–6, with the exception that the bottom sole 126 includes a skimmer or skid member 110 located as shown.

Figure 8:
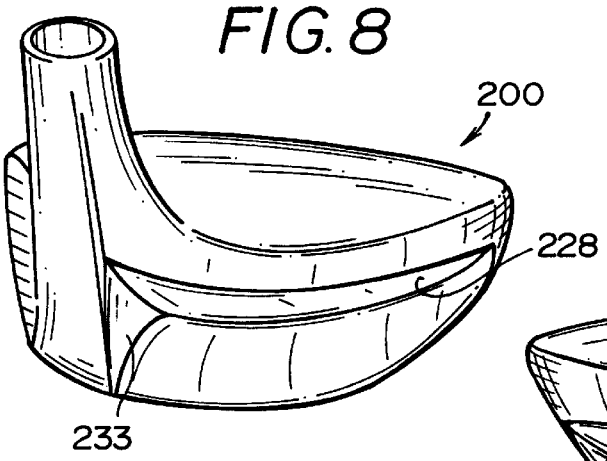
FIG. 8 is a heel end elevational view of a third embodiment of the present invention.
Figure 9:
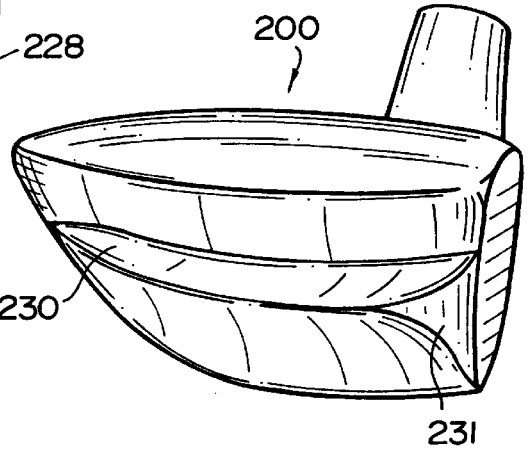
FIG. 9 is a toe end elevational view of the club of FIG. 8.
Figure 10:
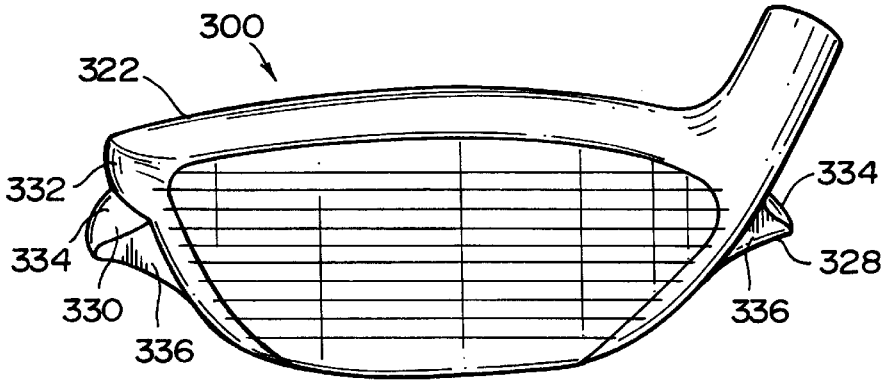
FIG. 10 is a front elevational view of a forth embodiment of a golf club head in accordance with the present invention.
Figure 11:
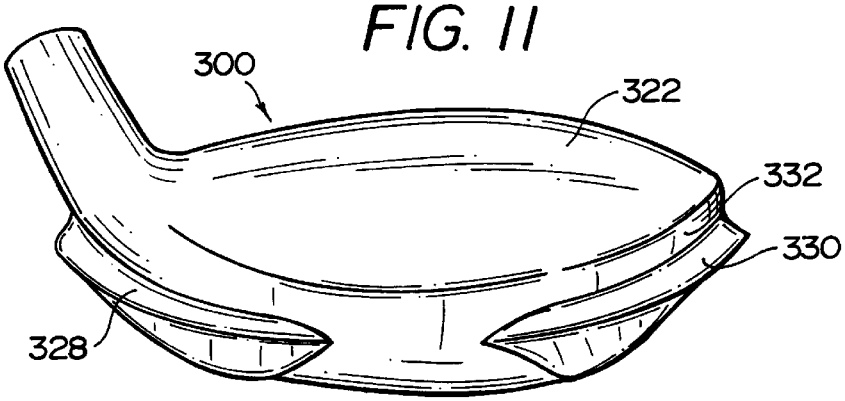
FIG. 11 is a rear elevational view of the club of FIG. 10.
Figure 12:
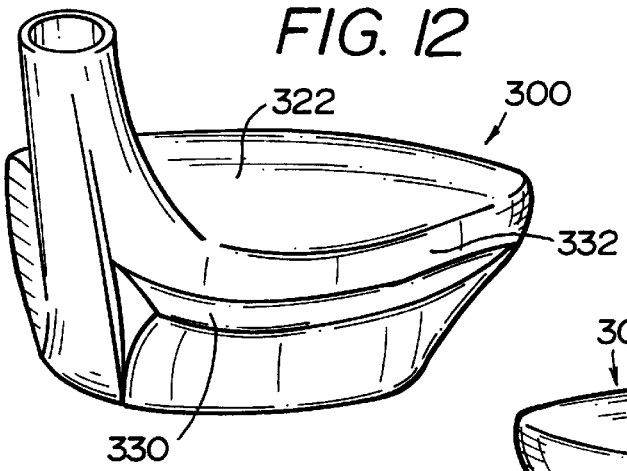
FIG. 12 is a heel end elevational view of the club of FIG. 10.
Figure 13:
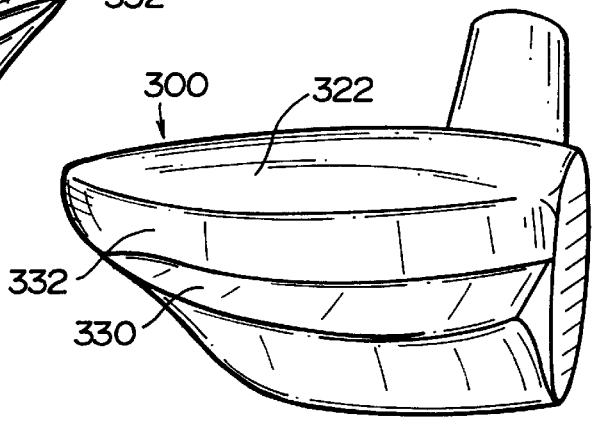
FIG. 13 is a toe end elevational view of the club of FIG. 10.

FIGS. 8 and 9 show a third embodiment of a golf club head 200 in accordance with the present invention which is also identical to the embodiment shown in FIGS. 1–6, with the exception that the appendages 228 and 230 include rearwardly flared front faces 231 and 233 which provide a smoother air flow as air spills rearwardly across the appendages 228 and 230.

FIGS. 10, 11, 12, and 13 show a fourth embodiment of a golf club head 300 in accordance with the present invention. In this embodiment, appendages 328 and 330 are located higher on the sides 332 toward the top surface 322 of the club head 300. Each appendage 328 and 330 has a parabolic upper surface 334 which slopes downwardly and a concave parabolic lower surface 336.

Figure 14:
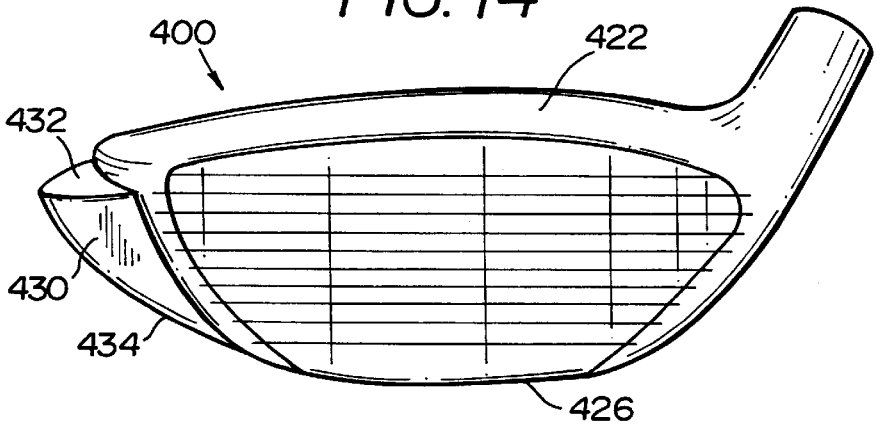
FIG. 14 is a front elevational view of a fifth embodiment of a golf club in accordance with the present invention.

FIG. 14 shows a fifth embodiment of a golf club head 400 in accordance with the present invention and includes a single appendage 430 located at the toe 418 having a flat upper surface 432 located adjacent a top surface 422 of the club head 400 and a lower, upwardly curving, convex parabolic surface 434 extending upwardly from adjacent a bottom sole 426 of the club head 400.

Figure 15:
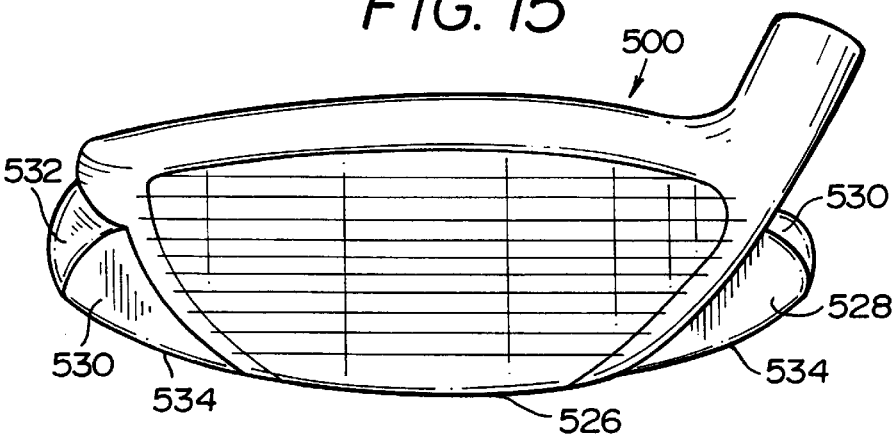
FIG. 15 is a front elevational view of a sixth embodiment of the present invention.

FIG. 15 shows a sixth embodiment of a golf club head 500 in accordance with the present invention including a pair of appendages 528, 530 located coincident with or adjacent to the bottom surface 526 of the club head 500. Each appendage 528 and 530 includes a parabolic upper surface 532 which slopes downwardly and a lower, upwardly curving, convex parabolic surface 534 extending upwardly from the bottom sole 526 of the club head 500.

Figure 16:
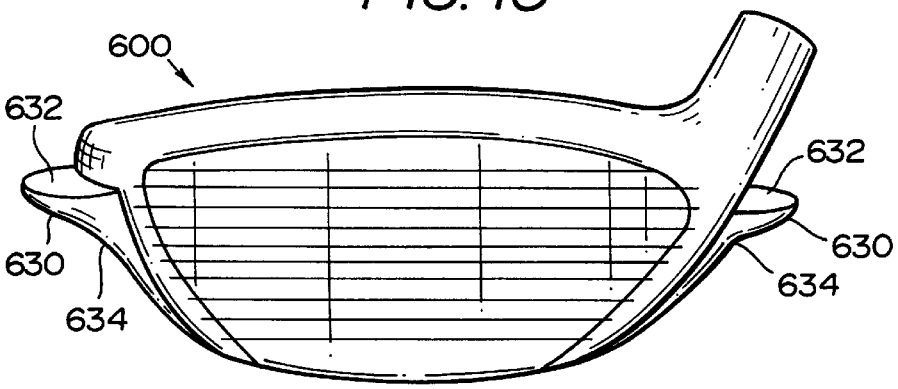
FIG. 16 is a front elevational view of a seventh embodiment of the present invention.

FIG. 16 shows an seventh embodiment of a club head 600 in accordance with the present invention formed of a solid aerodynamic wing-like appendage 630 having a flat upper surface 632 and a concave parabolic lower surface 634. It will be appreciated that the solid appendage 630 is formed exteriorly of the metal shell which forms the club head 600 and is relatively thin and lightweight in order to maintain the overall weight of the club head 600 within acceptable weight ranges.

Figure 17:
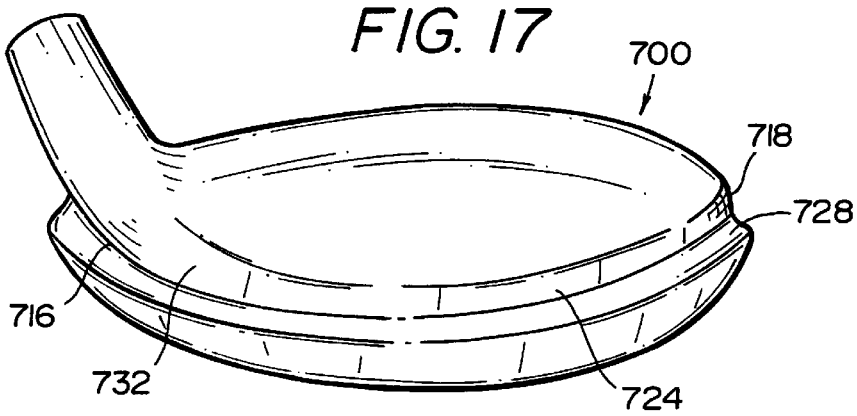
FIG. 17 is a rear elevational view of an eighth embodiment of the present invention.
Figure 18:
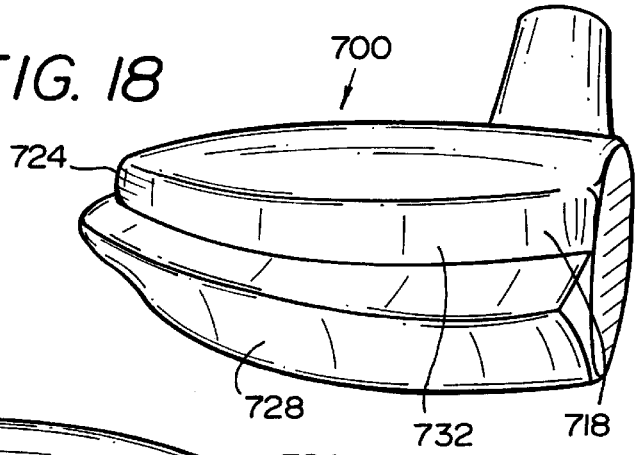
FIG. 18 is a toe end elevational view of the club head of FIG. 17.
Figure 19:
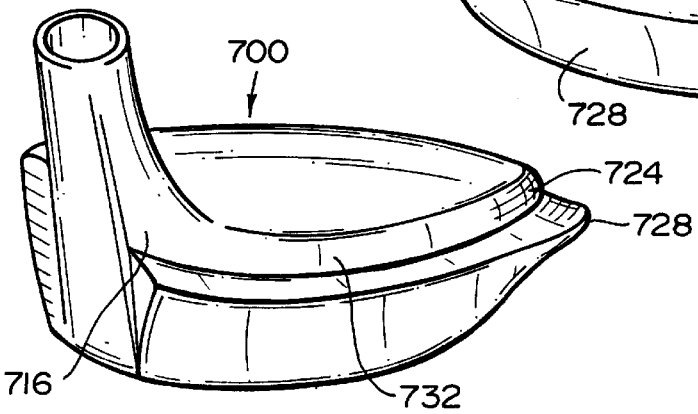
FIG. 19 is a heel end elevational view of the club head of FIG. 17.
Figure 20:
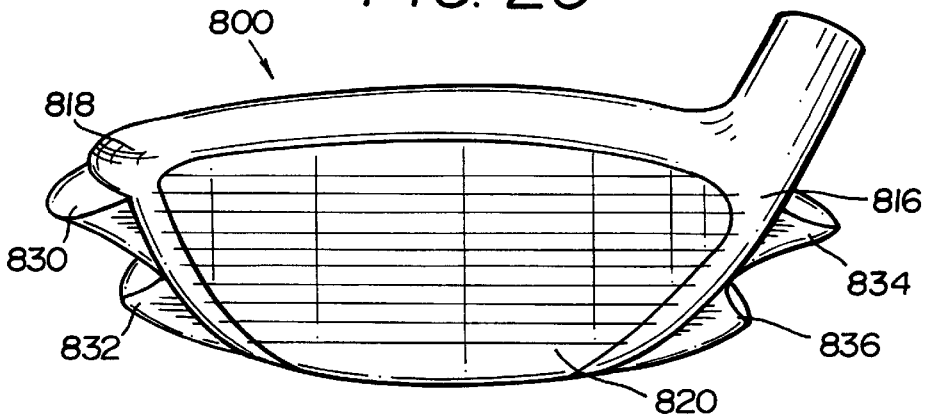
FIG. 20 is a front elevational view of a ninth embodiment of the present invention.
Figure 21:
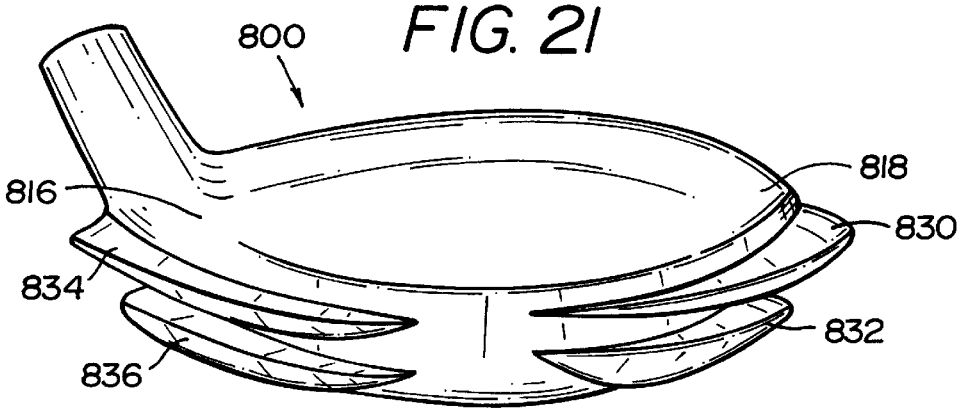
FIG. 21 is a rear elevational view of the club head of FIG. 20.
Figure 22:
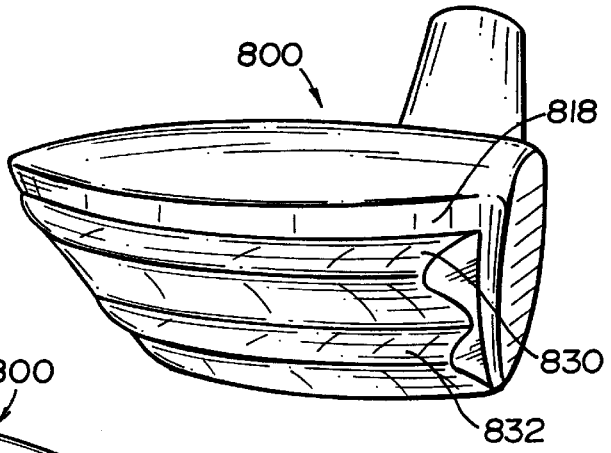
FIG. 22 is a toe end elevational view of the club head of FIG. 20.
Figure 23:
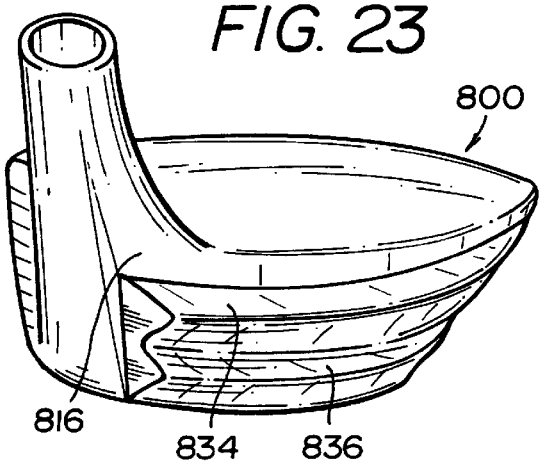
FIG. 23 is a heel end elevational view of the club head of FIG. 20.

FIGS. 17, 18 and 19 show an eighth embodiment of a golf club head 700 in accordance with the present invention including a single aerodynamic appendage 728 located at the sides 732 and rear surface 724 of the club head 700 extending from the heel 716 entirely across the rear surface 724 to the toe 718.

FIGS. 20, 21 22 and 23 show a ninth embodiment of a club head 800 in accordance with the present invention formed of a pair of upper and lower aerodynamic wing-like appendages 830 and 832 on the toe 818 and a second pair of appendages 834 and 836 on the heel 816 of the club head 800. The appendages are set back rearwardly from the ball striking face 820. As with the previous embodiments, the appendages are provided with parabolic, aerodynamic surfaces to create optimum air flow across the club head surfaces.

Figure 24:
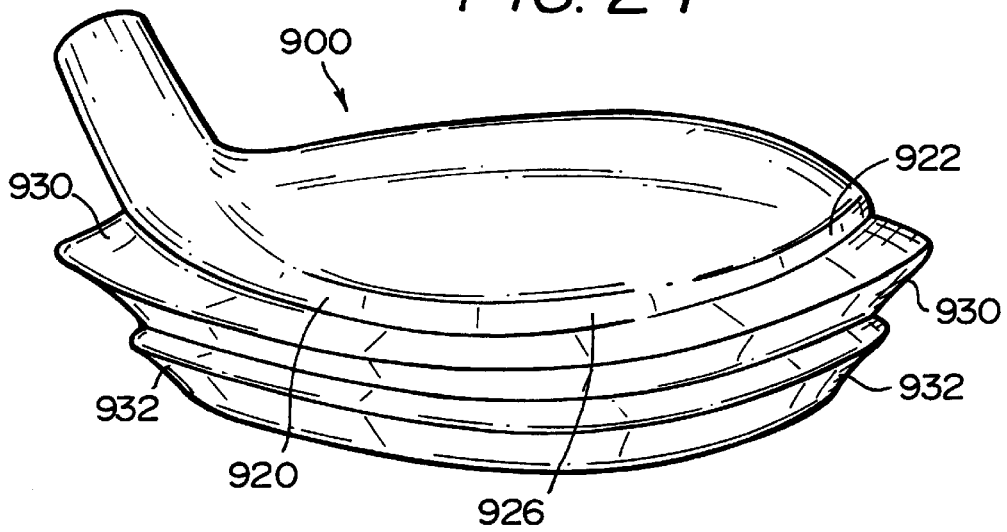
FIG. 24 is a rear elevational view of an tenth embodiment of the present invention.
Figure 25:
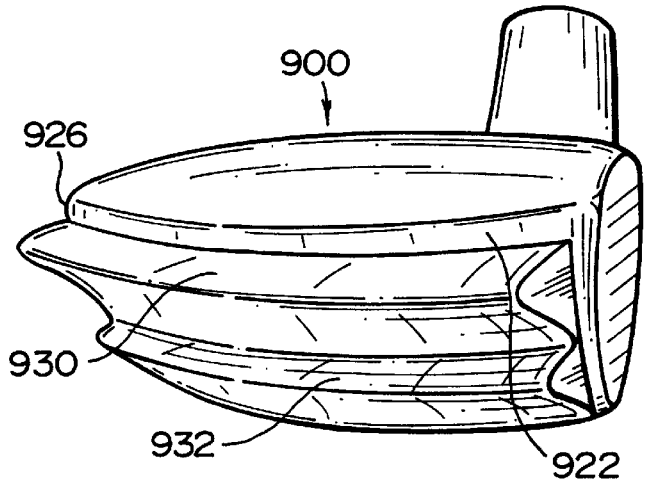
FIG. 25 is a toe end elevational view of the club head of FIG. 24.
Figure 26:
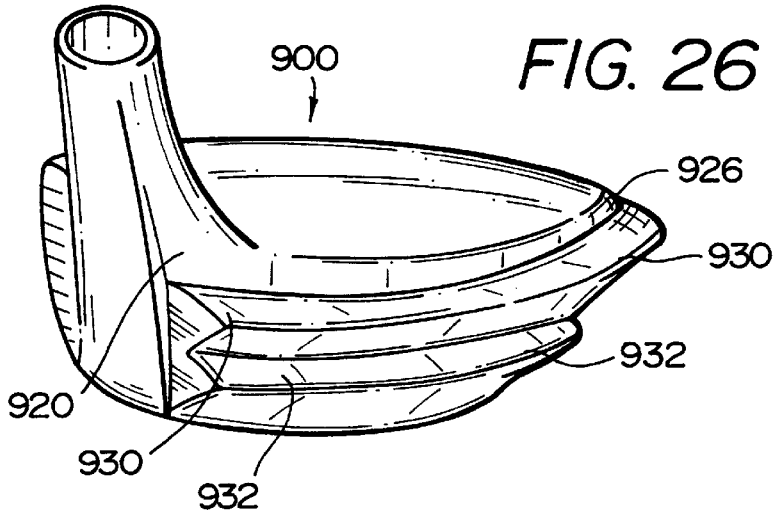
FIG. 26 is a heel end elevational view of the club head of FIG. 24.

FIGS. 24, 25 and 26 show a tenth embodiment of a club head 900 in accordance with the present invention formed of a pair of upper and lower aerodynamic wing-like appendages 930 and 932 both of which extend entirely around the heel side 920, rear surface 926 and toe side 922 of the club head 900. As with the previous embodiments, the appendages are provided with parabolic, aerodynamic surfaces to create optimum air flow across the club head surfaces.

FIGS. 27, 28 and 29 show an eleventh embodiment of a golf club head 1000 in accordance with the present invention which includes a single appendage 1030 located at the toe 1018 having a flat upper surface 1032 located adjacent a top surface 1022 of the club head 1000 and a lower, upwardly curving, convex parabolic surface 1034 extending upwardly from adjacent a bottom sole 1026 of the club head 1000. In this embodiment, the toe appendage 1030 has a front surface 1032 which is coincident with the ball striking face 1020, thereby enlarging the same and providing a greater margin for error when golf balls are struck toward the toe 1018.

Figure 30:
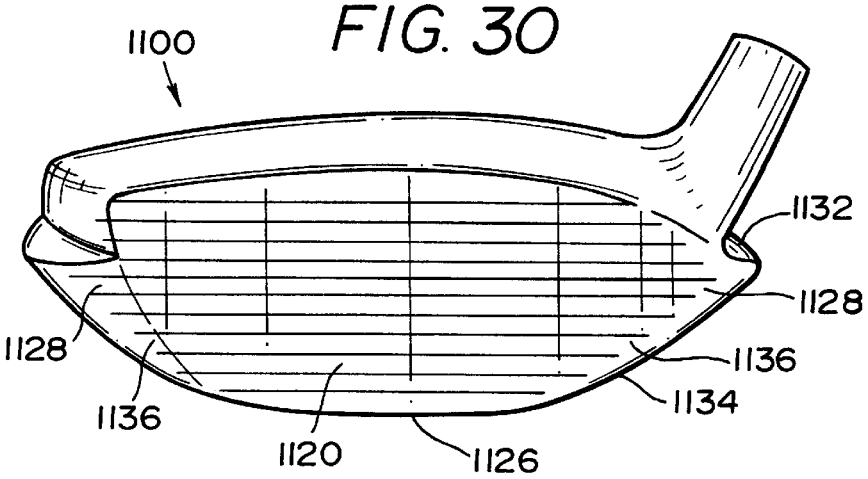
FIG. 30 is front elevational view of a twelfth embodiment of the present invention.
Figure 32:
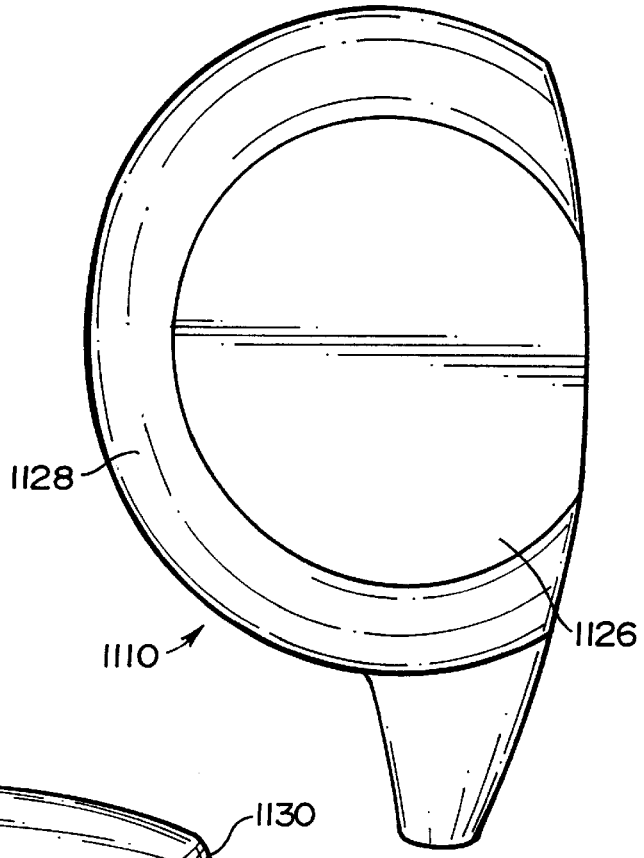
FIG. 32 is a bottom view of FIG. 30.
Figure 31:
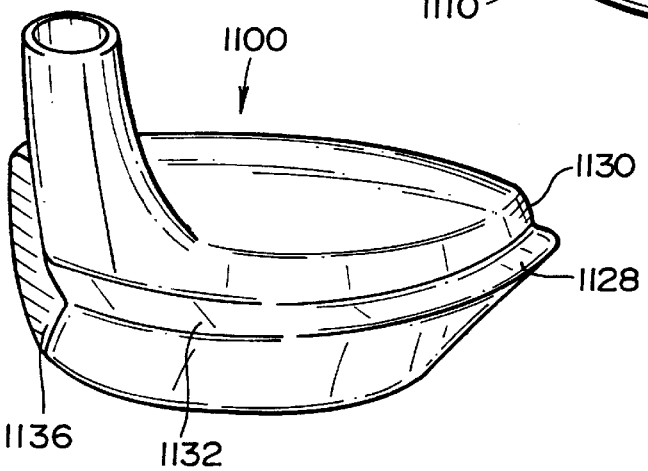
FIG. 31 is a heel end elevational view of the club head of FIG. 30.
Figure 37:
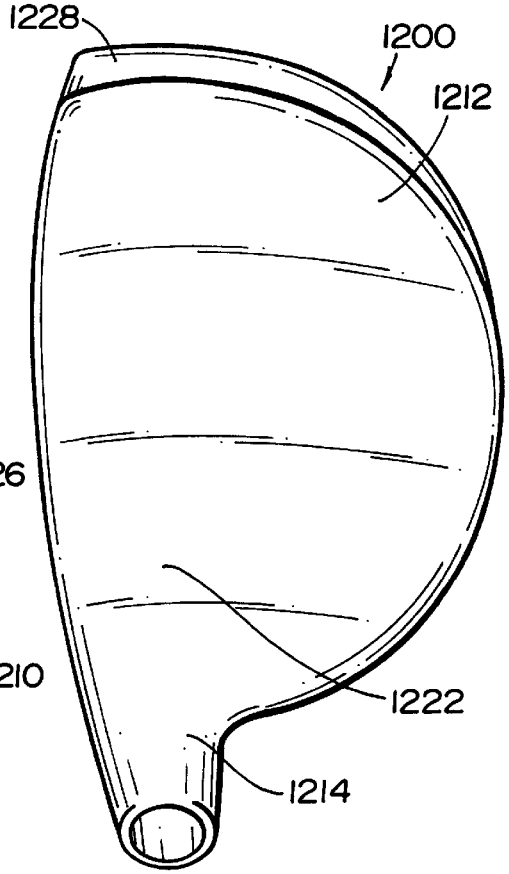
FIG. 37 is a top plan view of the club head of FIG. 33.
Figure 38:
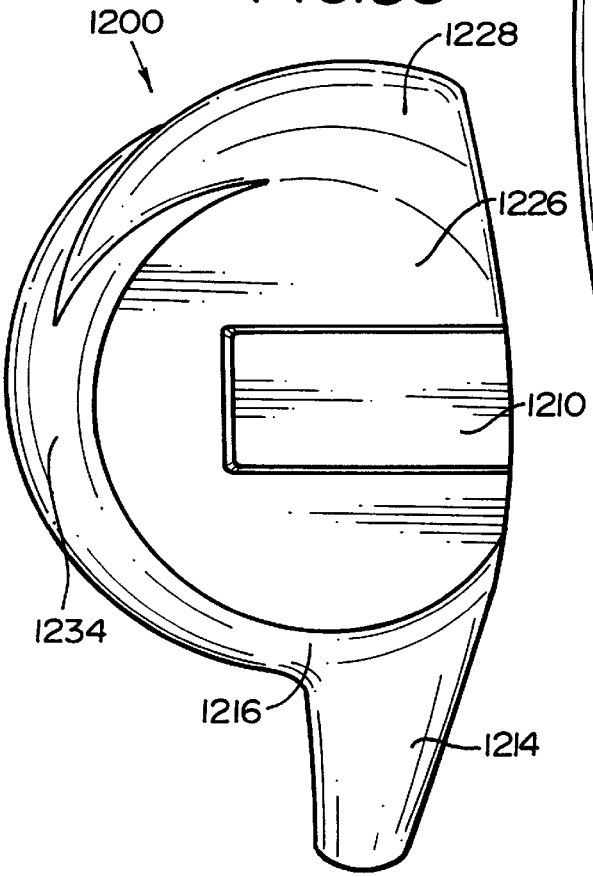
FIG. 38 is a bottom view of the club head of FIG. 33.
Figure 39:
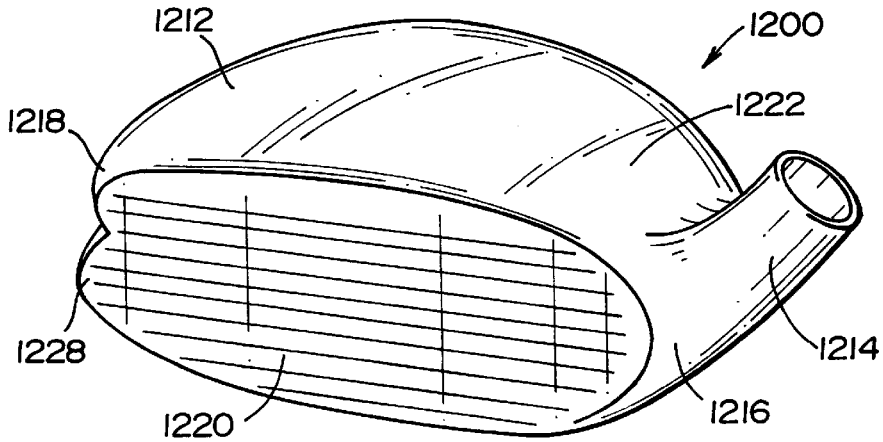
FIG. 39 is a front perspective view of the club head of FIG. 33.
Figure 40:
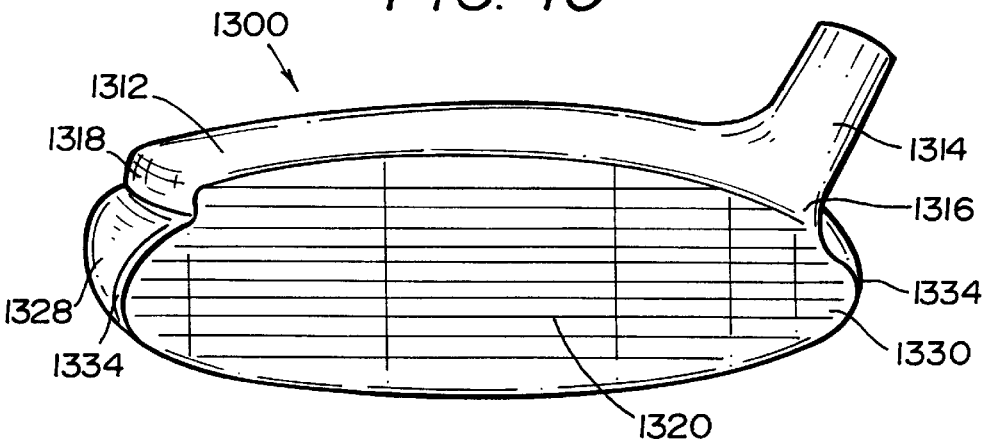
FIG. 40 is a front elevational view of a fourteenth embodiment of a golf club head in accordance with the present invention.
Figure 41:
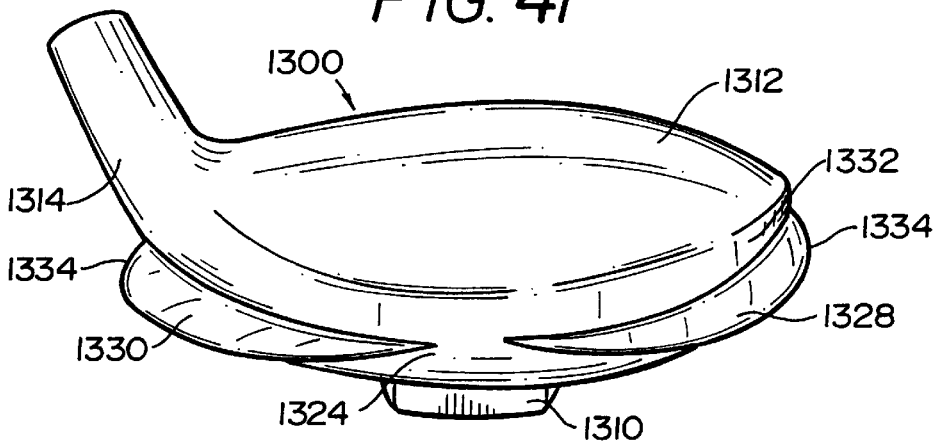
FIG. 41 is a rear elevational view of the club head of FIG. 40.
Figure 42:
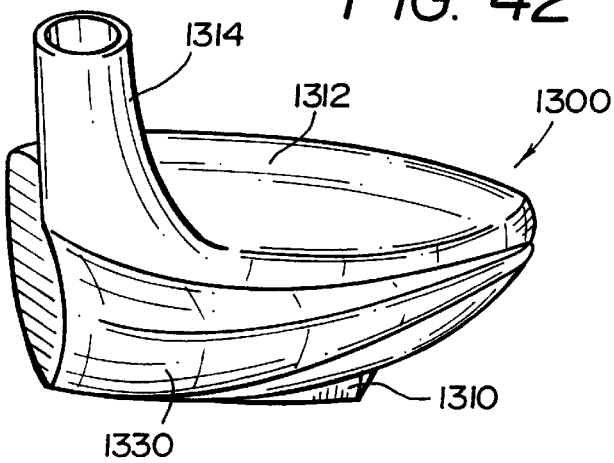
FIG. 42 is a heel end elevational view of the club head of FIG. 40.
Figure 43:
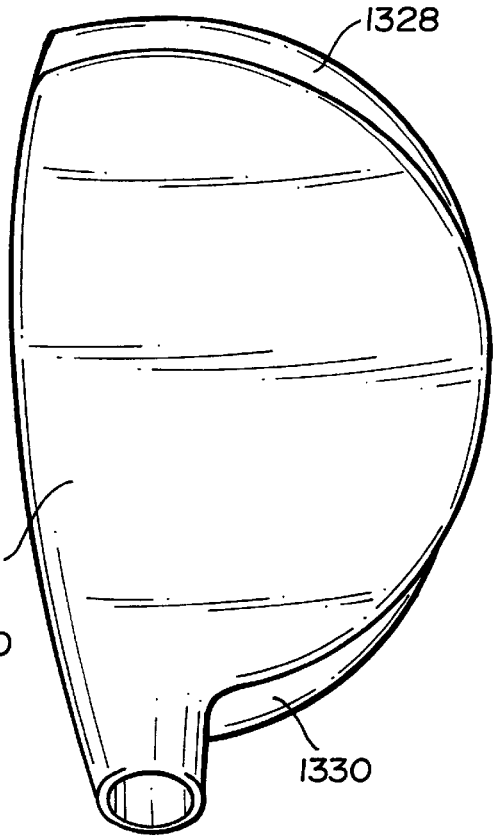
FIG. 43 is a top plan view of the club head of FIG. 40.
Figure 44:
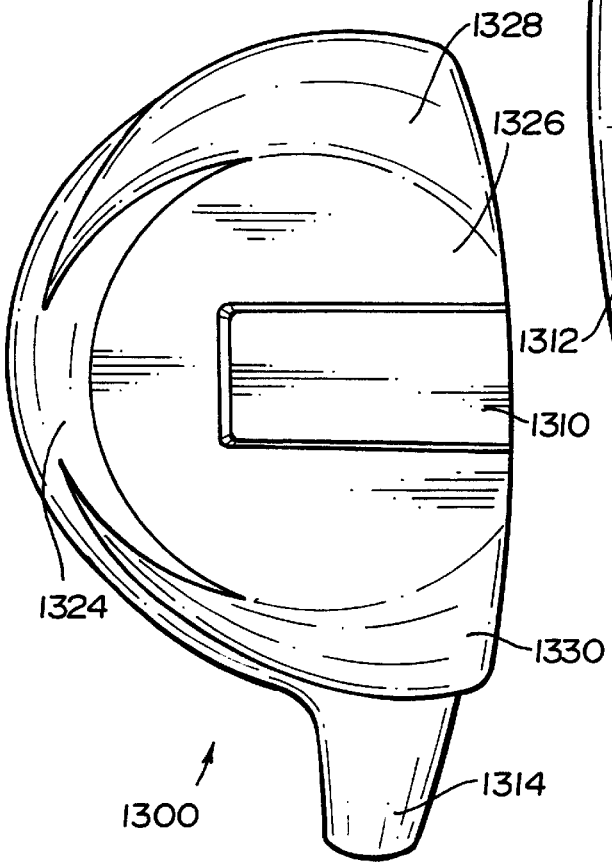
FIG. 44 is a bottom view of the club head of FIG. 40.
Figure 45:
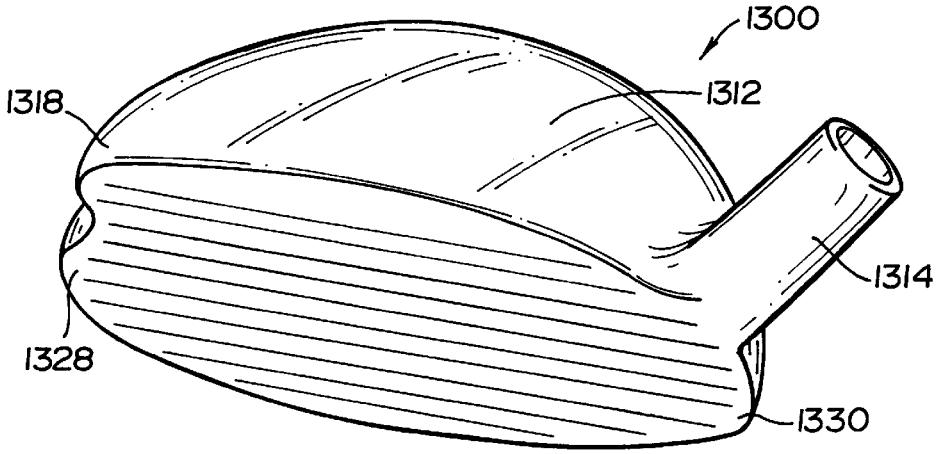
FIG. 45 is a front perspective view of the club head of FIG. 40.

FIGS. 30, 31 and 32 show a twelfth embodiment of a golf club head 1100 in accordance with the present invention including a single appendage 1128 located coincident with or adjacent to the bottom surface 1126 of the club head 1100 and which wraps totally around the peripheral sides 1130 of the club head 1100. The appendage 1128 includes an upper surface 1132 and a lower, upwardly curving, convex parabolic surface 1134 extending upwardly from the bottom sole 1126 of the club head 1100. In this embodiment, the appendage 1128 has a front surface 1136 which is coincident with the ball striking face 1120, thereby enlarging the same and providing a greater margin for error when golf balls are struck away from the center of the ball striking face 1120.

FIGS. 33 to 39 show a thirteenth embodiment of a golf club head 1200 including a club head body 1212, hosel 1214, heel 1216, toe 1218, ball striking face 1220, upper surface 1222, rear surface 1224 and bottom sole 1226. The improvement lies in a single wing-like aerodynamic appendage 1228 formed on a side wall 1232 of the club head 1200 and coincident with the ball striking face 1220. The appendage 1228 has an elongated, aerodynamic airfoil shaped surfaces 1234 generally curved and parabolic in shape which extends outwardly beyond the outer perimeter of the club head body 1212 as can particularly be seen with reference to FIGS. 33, 34, and 39. The appendage 1228 lies in a plane which is generally parallel to both the top surface 1222 and bottom surface 1226 of the club head 1200 and extend in a front to rear direction on the club head 1200 from a point adjacent the ball striking face 1220 to the rear surface 1224. In this embodiment the front surface 1238 of the appendage 1228 is coincident with said ball striking face 1220 and is formed in the shape of a curved parabola having a longitudinal axis parallel to the longitudinal axis of the ball striking face 1220, and actually provides an enlarged hitting area at the toe 1218 of the club head 1200.

As with the previous embodiments, the appendage 1228 extends outwardly from the side 1232 of the club head 1200 an overall appearance of a larger club head is presented to the golfer than would appear with a conventional sized club head body. The appendage 1228 adds additional peripheral weight to the club head 1200, particularly in a heel 1216 to toe 1218 direction and adds strength and stability to the club head 1200. The aerodynamic surfaces of the parabolic appendage 1228 creates favorable, productive turbulence, thus reducing drag at the rear surface 1224 of the club head 1200 increasing club head speed and creating lift as it is swung, particularly when used by a player generating fast club head speed swings. As can be seen from FIG. 34, the appendage 1228 extends toward, but does not reach, the entire way around the rear surface 1224. The bottom sole 1226 includes a skimmer 1210.

FIGS. 40 to 45 show a fourteenth embodiment of a golf club head 1300 including a club head body 1312, hosel 1314, heel 1316, toe 1318, ball striking face 1320, upper surface 1322, rear surface 1324 and bottom sole 1326. In this embodiment a pair of wing-like aerodynamic appendages 1328, and 1330 are formed on the side 1332 of the club head 1300 and set behind the ball striking face 1320. Each of the appendages 1328, 1330 have an elongated, aerodynamic airfoil shaped surfaces 1334 generally curved and parabolic in shape and extend outwardly beyond the outer perimeter of the club head body 1300. The appendages 1328 and 1330 lie in a plane which is generally parallel to both the top surface 1322 and bottom surface 1326 of the club head 1300 and extend in a front to rear direction on the club head 1300 from a point adjacent the ball striking face 1320 to the rear surface 1324.

As with the previous embodiment, the appendages 1328 and 1330 are coincident with the ball striking face 1320 and actually provide an enlarged hitting area at the toe 1318 and heel 1316 of the club head 1300. As can be seen from FIG. 41, the appendages 1328, and 1330 extend toward, but do not reach, the entire way around the rear surface 1324. The bottom sole 1326 includes a skimmer 1310.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A wood type golf club head including a club head body having a shell with a toe, heel, top surface, bottom sole, side surfaces, rear surface and ball striking face with a bulge and roll surface configuration, wherein the improvement comprises:

means on said side surfaces for adding reinforcement, expanding perimeter weighting and providing low profile aerodynamics, said means including at least one raised, elongated, aerodynamically shaped appendage extending outwardly from said side surfaces, in a front to rear direction, from a point adjacent said ball striking face to said rear surface said appendage being located below the interface of said top surface and said side surfaces and said rear surface.

2. The golf club of claim 1 being further defined by an appendage on a toe side surface and an appendage on a heel side surface.

3. The golf club of claim 2 wherein said appendages terminate at spaced points on said rear surface.

4. The golf club of claim 1 wherein said appendage is further defined by parabolic, aerodynamic surfaces.

5. The golf club of claim 4 wherein said appendage includes a downwardly curving, convex upper surface.

6. The golf club of claim 4 wherein said appendage includes a downwardly curving, convex lower surface.

7. The golf club of claim 4 wherein said appendage includes a downwardly curving, concave lower surface.

8. The golf club of claim 4 wherein said appendage includes a flat upper surface.

9. The golf club of claim 8 wherein said appendage includes a downwardly curving, concave lower surface.

10. The golf club of claim 1 wherein said appendage is located adjacent said top surface.

11. The golf club of claim 1 wherein said appendage is located adjacent said bottom sole.

12. The golf club of claim 11 wherein said appendage is coincident with said bottom sole.

13. The golf club of claim 1 wherein said appendage is a single elongated member and extends from adjacent said ball striking face at said toe to said rear surface to said ball striking face at said heel.

14. The golf club of claim 1 being further defined by an upper and lower pair of appendages on a heel side surface and an upper and lower pair of appendages on said toe side surface.

15. The golf club of claim 1 being further defined by upper and lower appendages extending around said club head body from a point on said toe adjacent said ball striking face, across said rear surface to a point on said heel adjacent said ball striking face.

16. The golf club of claim 1 wherein said appendage includes a front surface.

17. The golf club of claim 16 wherein said front surface of said appendage is coincident with said ball striking face.

18. The golf club of claim 16 wherein said front surface of said appendage is set behind said ball striking face.

19. The golf club of claim 16 wherein said front surface of said appendage is set behind said ball striking face and is rearwardly flared toward said rear surface.

20. The golf club of claim 1 wherein said bottom sole includes a skid member.

21. The golf club of claim 1 wherein said appendage is coincident with said ball striking face and is formed in the shape of a curved parabola having a longitudinal axis parallel to the longitudinal axis of the ball striking face.

22. The golf club of claim 21 being further defined by an appendage on a toe side surface and an appendage on a heel side surface.

23. The golf club of claim 1 wherein said appendage is formed on a toe side surface of said club head body.

24. The golf club of claim 1 wherein said shell is made of metal.

25. The golf club of claim 1 further including a skimmer on said bottom sole.

* * * * *